US005456352A

United States Patent [19]

McQueeny

[11] Patent Number: 5,456,352

[45] Date of Patent: Oct. 10, 1995

[54] PACKAGE FOR KITS

[75] Inventor: Thomas P. McQueeny, Chicago, Ill.

[73] Assignee: R. R. Donnelley & Sons Company, Lisle, Ill.

[21] Appl. No.: 215,911

[22] Filed: Mar. 22, 1994

[51] Int. Cl.[6] ..... B65D 69/00

[52] U.S. Cl. ..... 206/223; 206/45.14; 229/120.28

[58] Field of Search ..... 206/223, 576, 206/579, 45.14, 45.31; 229/120.28, 162

[56] References Cited

U.S. PATENT DOCUMENTS

| | | | |
|---|---|---|---|
| Re. 22,417 | 1/1944 | Hassenfield | 229/27 |
| Re. 30,695 | 8/1981 | Transport | 206/45.24 |
| 1,682,449 | 8/1928 | Vest | 206/45.31 |
| 2,132,632 | 10/1938 | Kondolf | 206/45.14 |
| 2,711,819 | 6/1955 | Vander Lugt, Jr. | 206/45.31 |
| 3,029,936 | 4/1962 | Graber | 206/47 |
| 3,144,932 | 8/1964 | Zerbo, Jr. | 206/47 |
| 3,284,927 | 11/1966 | Milne | 35/26 |
| 3,595,382 | 7/1971 | Hofer | 206/45.31 |
| 3,840,113 | 10/1974 | Bartleson | 206/223 |
| 4,022,318 | 5/1977 | Goodman | 206/223 |
| 4,024,880 | 5/1977 | Newton et al. | 206/223 |
| 4,294,348 | 10/1981 | Hastings | 206/1.7 |
| 4,579,220 | 4/1986 | Brundage | 206/45.14 |
| 4,584,042 | 4/1986 | Wandroik | 156/280 |
| 4,828,114 | 5/1989 | Bardeen | 206/575 |
| 4,972,943 | 11/1990 | Fludd | 206/45.24 |
| 5,025,920 | 6/1991 | Walsh et al. | 206/223 |

*Primary Examiner*—David T. Fidei

*Attorney, Agent, or Firm*—Marshall, O'Toole, Gerstein, Murray & Borun

[57] ABSTRACT

In order to enhance the desirability of packaging for kits, and particularly the packaging for kits which include supplies, activity books, and the like, a unique and improved package for a kit is disclosed. The package includes a compartment which is suited for storing materials where the compartment is defined by a side wall and a bottom wall. A lid is also provided for overlying the compartment to selectively close and open the compartment, and, in addition, a cover is provided for the materials storing compartment defined by the side wall and the front wall. The package is such that the cover is removable position able over the compartment in box-like fashion, with the front wall of the cover in juxtaposition with the lid of the compartment. With these features, the package may be used for a kit so as to transport the contents, facilitate the use of the contents, and store the contents in an organized fashion following purchase.

25 Claims, 2 Drawing Sheets

PACKAGE FOR KITS

FIELD OF THE INVENTION

The present invention is generally directed to packaging and, more particularly, a package for shipping, using, and storing materials in kit form.

BACKGROUND OF THE INVENTION

Over the years, there has been an ever-increasing market for an extremely wide variety of kits that have captured consumer interest. These have essentially run the gamut from kits for creating art forms, such as a paintings or the like, to jewelry-making kits and even pumpkin-carving kits, as only a few examples. Generally speaking, the kits must be contained in some form of packaging for purposes of shipping them to their destinations.

In this connection, there is a great awareness of the vast problem of waste disposal particularly for solid wastes. Moreover, it is quite well known that product packaging is a significant source of the solid wastes which typically either finds its way into landfills or is burned. In either case, the result is less than acceptable since the landfills are nearly at capacity and burning creates pollution.

For this reason, there have been attempts to deal with the problem of packaging for kits in various unique ways such as that proposed in Wandroik, U.S. Pat. No. 4,584,042. It is there suggested to provide a box or carrying case for the materials of a kit wherein the box or carrying case can presumably also serve as its packaging, and the same is also true of Fludd, U.S. Pat. No. 4,972,943; Goodman, U.S. Pat. No. 4,022,318; Hastings, U.S. Pat. No. 4,294,348; Bartleson, U.S. Pat. No. 3,840,113; and Milne, U.S. Pat. No. 3,284,927 among others. In addition, there have been still other kits in packages as represented by Bardeen, U.S. Pat. No. 4,828,114; Zerbo, Jr., U.S. Pat. No. 3,144,932; and Graber, U.S. Pat. No. 3,029,936.

With regard to these attempts at kit packaging, they have each addressed one or more or the problems that are faced in this field, but it is generally recognized that none of these earlier attempts has been entirely satisfactory. This is particularly true for kit applications where the packaging serves not only the normal function of transporting the contents of the kit but also the additional functions of facilitating the use of the contents and thereafter storing them in an organized fashion between uses. Still additionally, the earlier packaging has failed to combine a cover with a window to display a portion of the contents, a means of supporting an activity book, a fold-down box for housing kit materials, and an inner lid that opens to provide a cutting board.

The present invention is directed to overcoming one or more of the foregoing problems and achieving one or more of the resulting objects.

SUMMARY OF THE INVENTION

It is, therefore, a principal object of the present invention to provide a unique and improved form of kit packaging. It is a further object of the present invention to provide packaging suitable for not only transporting the contents of a kit but also facilitating their use and storing them after purchase in an organized fashion. It is an additional object of the present invention to provide kit packaging for supporting an activity book and providing a cutting board.

Accordingly, the present invention is directed to a package for a kit which includes a compartment defined by a side wall and a bottom wall for storing materials. The package also includes a lid for overlying the compartment to selectively close and open it as well as a cover for the materials storing compartment defined by a side wall and a front wall. With this construction, the cover will be understood to be removably positionable over the compartment in what may be described as box-like fashion.

In the exemplary embodiment, the cover is removably positionable with the front wall thereof in juxtaposition with the lid of the compartment. The materials storing compartment is preferably generally rectangularly shaped with an open top, anti the side wall defining the materials storing compartment preferably includes four side wall portions integral with the bottom wall thereof. The lid is advantageously hinged to either the side wall or bottom wall defining the materials storing compartment for pivoting the lid from the position overlying the compartment to thereby open the compartment. The materials storing compartment cover is preferably generally rectangularly shaped with an open bottom, and the side wall defining the compartment cover preferably includes four side wall portions integral with the front wall thereof. The cover is advantageously hinged to either the side wall or bottom wall defining the materials storing compartment for pivoting the cover from juxtaposition with the lid to expose the lid for opening the compartment. With these features, the materials storing compartment advantageously includes a window in the front wall for viewing an image therethrough.

In a most highly preferred embodiment, the bottom wall and side wall portions defining the materials storing compartment form a rectangular box having a top, a bottom, and a pair of sides. The materials storing compartment cover is preferably hinged at the top of the rectangular box, and the lid is hinged at one of the sides thereof. Also, the bottom wall defining the materials storing compartment advantageously extends beyond the side wall portions along the sides, as well as the top and bottom of the rectangular box. The extending portions along the sides of the rectangular box preferably form flaps to be folded against the corresponding side wall portions. Further, the lid is advantageously hinged to one of the flaps to be pivoted so as to overlie the compartment for closing it at the same time that both of the flaps are folded against the corresponding side wall portions. Because of these features of construction, it will be appreciated that the cover is permitted to be removably positioned over the rectangular box in generally box-like fashion.

As for the extending portions along the top and bottom of the rectangular box, they serve two distinct functions that enhance the desirability of the packaging, i.e., the extending portion at the top of the box forms a hinge line where the cover is hinged so as to be removably positioned over the compartment in box-like fashion. The bottom wall also advantageously extends beyond the top of the rectangular box by a distance greater than the height of the side wall portions of the cover to accommodate placement and support of an opened book between the side wall portions of the cover and the top of the rectangular box when the cover has been pivoted so as to be perpendicular to the box. With regard to the extending portion along the bottom of the rectangular box, it advantageously includes a tuck flap defined by a hinge line spaced from the bottom of the rectangular box and having a pair of opposed flap extensions to be inserted into flap extension-receiving openings in the cover.

Still additionally, the portion of the bottom wall between the bottom of the rectangular box and the hinge line preferably includes an oblong finger-receiving flap which is generally parallel to the side wall portion along the bottom of the rectangular box and generally parallel to the tuck flap.

As for the lid, it advantageously is formed so as to have a cutting board integral with the surface which faces the rectangular box when the lid is overlying the compartment. The rectangular box also preferably has a divider for forming at least two supply-receiving compartment portions and has an activity book to be positioned between the lid and the front wall of the cover. In the most highly preferred embodiment of the invention, the activity book has an image which can be viewed through the transparent covering on the opening through the front wall of the cover.

Other objects, advantages and features of the present invention will become apparent from a consideration of the following specification taken in conjunction with the accompanying drawings.

DETAILED DESCRIPTION OF THE PREFERRED EMBODIMENT

Figure 1:
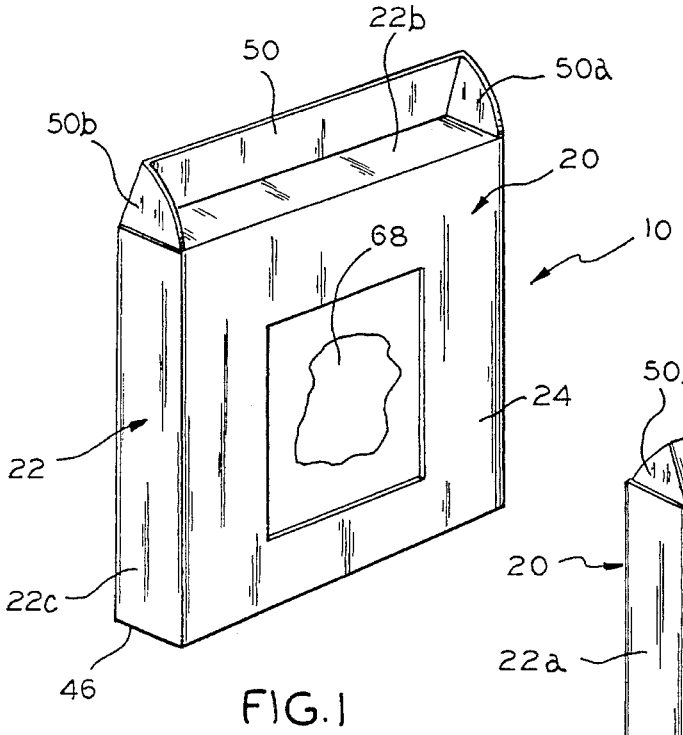
FIG. 1 is a front perspective view of a kit package in accordance with the present invention.
Figure 2:
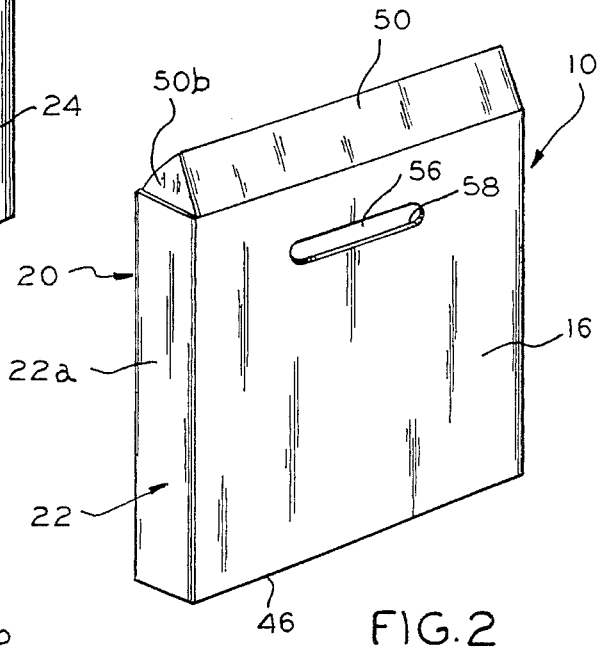
FIG. 2 is a rear perspective view of a kit package in accordance with the present invention.

In the illustrations given, and with reference first to FIG. 1, the reference numeral 10 designates generally a package for a kit in accordance with the present invention. The package 10 includes a compartment 12 (see FIG. 4) for storing kit materials defined by a side wall 14 and a bottom wall 16. In addition to the foregoing, and as shown in FIG. 2, the package 10 includes a lid 18 for overlying the compartment 12 to selectively close and open the compartment 12.

Figure 3:
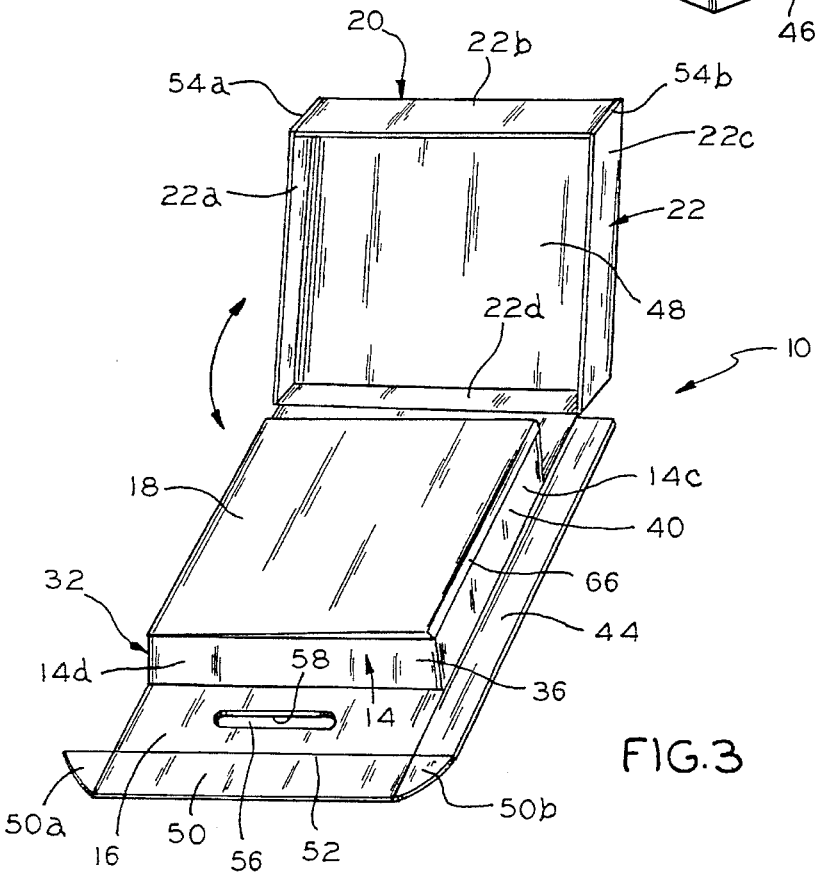
FIG. 3 is a perspective view of a partially-opened kit package of the type shown in FIGS. 1 and 2.

As will be appreciated by comparing FIGS. 1 and 3, the package 10 includes a cover 20 for the materials storing compartment 12 defined by a side wall 22 and a front wall 24. The cover 20 is removably positionable over the compartment 12 in generally box-like fashion such that the front wall 24 is in juxtaposition with the lid 18 over the compartment 12 see (FIG. 3). In the embodiment as illustrated, the materials storing compartment 12 defined by the side wall 14 and bottom wall 16 will be seen to be generally rectangularly shaped with an open top 26.

Figure 4:
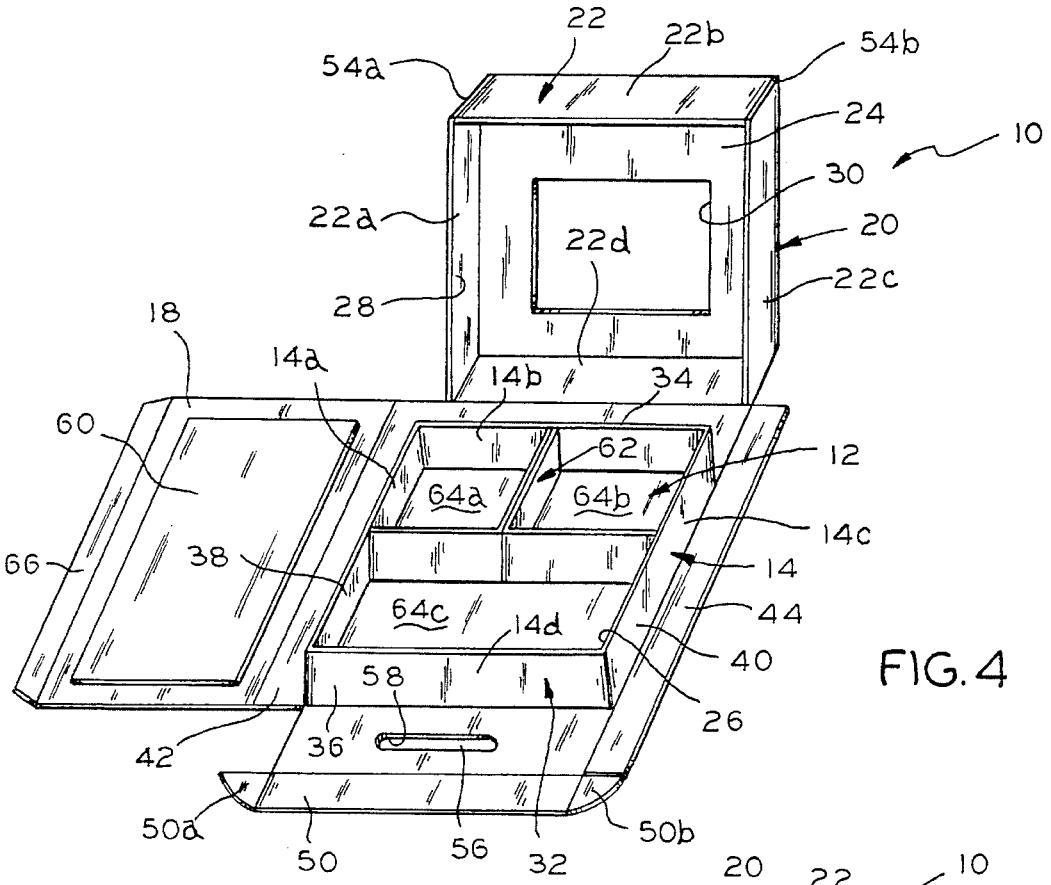
FIG. 4 is a perspective view of a fully-opened kit package of the type illustrated in FIGS. 1 and 2.

Referring to FIG. 4, the side wall 14 defining the materials storing compartment 12 includes four side wall portions 14*a–d* integral with the bottom wall 16 thereof. The lid 18 is hinged to either the side wall 14 or the bottom wall 16 which define the materials storing compartment 14, and preferably to the bottom wall 16 as illustrated, so as to be able to pivot the lid 18 from the position overlying the compartment 12 as showing FIG. 3 to thereby open the compartment 12 (see FIG. 4). In the embodiment illustrated in FIG. 4, the materials storing compartment cover 20 will be seen to be preferably generally rectangularly shaped with an open bottom 28.

Still referring to FIG. 4, the side wall 22 defining the compartment cover 20 includes four side wall portions 22a-d which are integral with the front wall 24 thereof. The cover 20 is hinged to either the side wall 14 or the bottom wall 16 which define the materials storing compartment 12, and preferably to the bottom wall 16, so as to be able to pivot the cover 20 from juxtaposition with the lid 18 as shown in FIG. 1 to expose the lid 18 for opening the compartment 12 (see FIGS. 3 and 4). In the embodiment illustrated in FIG. 4, the materials storing compartment cover 20 includes a window 30 in the front wall 24 of the cover 20 for viewing an image therethrough.

In particular, the window 30 accommodates an image on or between the lid 18 and the front wall 24 whenever the front wall 24 is in juxtaposition with the lid 18, e.g., as shown in FIG. 1.

From the foregoing, it will be understood that the lid 18 is preferably hinged to the bottom wall 16 for pivoting the lid 18 from a first position overlying the compartment 12 (FIG. 3) wherein the compartment 12 is closed to a second position generally adjacent the compartment 12 (FIG. 4) wherein the compartment is open. Also, the cover 20 is preferably hinged to the bottom wall 16 for pivoting the cover 20 from a first position over the compartment 12 (FIG. 1) with the front wall 24 and the lid 18 juxtaposed to a second position (FIG. 3) generally adjacent and perpendicular to the compartment 12 in order to expose the lid 18 for opening the compartment 12.

Figure 5:
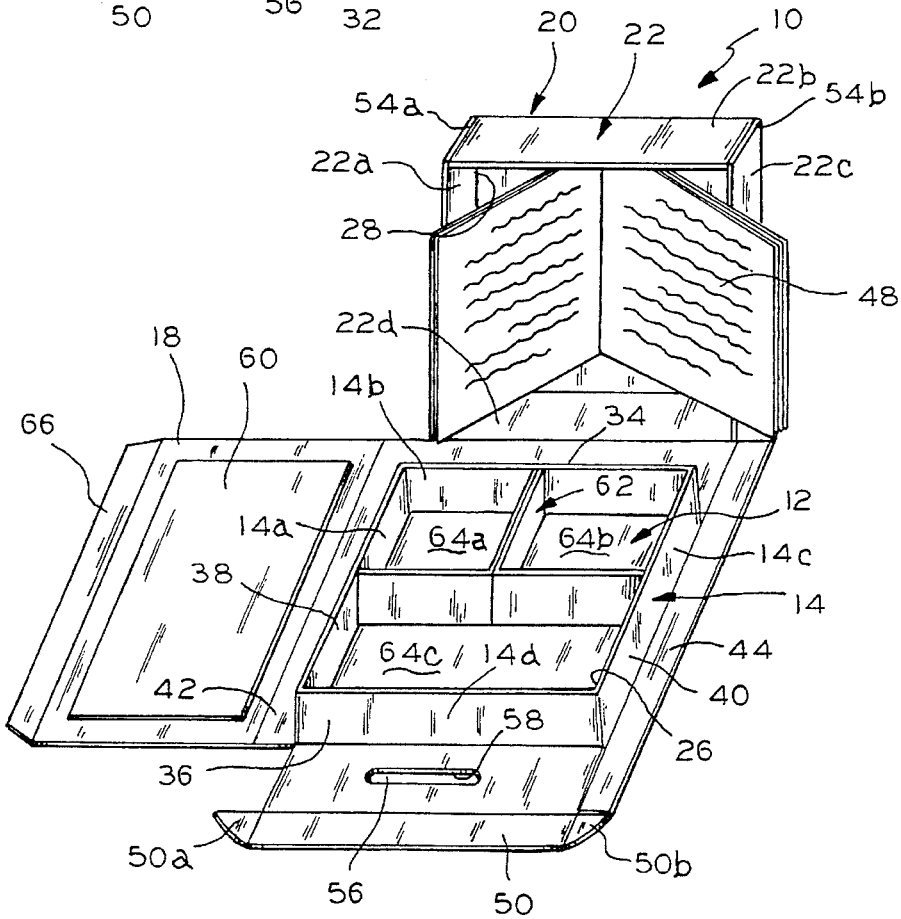
FIG. 5 is a perspective view similar to FIG. 4 showing the kit package in a use position.

Referring to FIGS. 4 and 5, the side wall portions 14a-d and the bottom wall 16 form a rectangular box 32 having a top 34, a bottom 36, and a pair of sides 38 and 40, and the materials storing compartment cover 20 will be understood to be hinged generally at or adjacent the top 34 of the rectangular box 32 with the lid 18 being hinged generally at or adjacent one of the sides such as 38 thereof. More specifically, the bottom wall 16 will be seen to extend beyond the side wall portions 14*a–d* along the top 34, bottom 36, and sides 38 and 40 of the rectangular box 32 to form flaps 42 and 44 which are to be folded against the corresponding ones of the side wall portions 14*a* and 14*c* before the cover 20 is removably positioned so as to be over the rectangular box 32 in generally box-like fashion. In this connection, the lid 18 is formed as an integral hinged continuation of one of the flaps 42 formed by the portion of the bottom wall 16 which extends beyond the side wall portion 14*a* to be pivoted to the first position overlying the compartment 12 for closing the compartment 12 when the one of the flaps 42 is folded against the corresponding one of the side wall portions 14*a*.

Still additionally, the portion of the bottom wall 16 which extends beyond the side wall portion 14b along the top 34 of the rectangular box 32 forms a hinge line 46 (see FIG. 1 ) which is spaced from the top 34 of the rectangular box 32, and the cover 20 is hinged to the extended bottom wall 16 at the hinge line 46 to be removably positioned over the compartment 12 in generally box-like fashion. Preferably, the bottom wall 16 extends beyond the top 34 of the rectangular box 32 by a distance greater than the height of the side wall portions 22*a–d* of the cover 20 to accommodate placement and support of a book 48 in the manner illustrated (see FIG. 5) between the side wall portions 22*a* and 22*c* of the cover 20 and the top 34 of the rectangular box 32 when the cover 20 has been pivoted so as to be generally perpendicular to the rectangular box 32. Still additionally, the bottom wall 16 preferably extends beyond the side wall portion 14*d* along the bottom 36 of the rectangular box 32 and includes a tuck flap 50 (see FIG. 4) which is defined by a hinge line 52 that is spaced from the bottom 36 of the rectangular box 32, and the tuck flap 50 will be seen to have a pair of opposed flap extensions 50*a* and 50*b* to be inserted into flap extension-receiving openings 54*a* and 54*b* in the cover 20.

Referring to FIGS. 2, 4 and 5, the package 10 includes an oblong finger-receiving flap 56 formed in the portion of the bottom wall 16 between the bottom 36 of the rectangular box 32 and the hinge line 52 so as to be generally parallel to the side wall portion 14*d* along the bottom 36 of the rectangular box 32 and generally parallel to the tuck flap 50. The oblong finger-receiving flap 56 may be pushed inwardly into the interior space of the packaging as suggested by FIG. 2 to expose an opening 58 for inserting the fingers on one hand to carry the package 10. In other words, it will be understood that a person carrying the package 10 can do so by simply inserting the fingers on one hand through the opening 58 to deflect the oblong finger-receiving flap 56 inwardly into the dead space between the side wall portion 14*d* and the tuck flap 50 whereby the opening 58 serves as a handle for carrying the package 10 from place to place.

As best shown in FIGS. 4 and 5, the lid 18 may advantageously have a cutting board 60 integral with the surface facing the rectangular box 32 when the lid 18 is in the first position overlying the compartment 12. The rectangular box 32 may also have a divider 62 for forming two or more supply-receiving compartment portions such as 64*a–c* and the activity book can be positioned between the lid 18 and the front wall 24 of the cover 20 for shipment. The lid 18 further preferably has a tuck flap 66 to be inserted into the rectangular box 32 when the lid 18 is in the first position to thereby close the compartment 12. Still further, and as will be fully appreciated by referring to FIG. 1, the activity book 48 advantageously has an image 68 such as a drawing, photograph or the like to be viewed through the opening 30 in the front wall 24.

In this connection, the opening 30 in the front wall 24 of the cover 20 defines a window which may advantageously have a transparent covering for viewing an image such as 68. This may be an image on the activity book 48 or an image appearing directly on the lid 18 if no book such as 48 is included or, alternatively, an image on any other article placed between the lid 18 and the front wall 24. With this arrangement, the image such as 68 is visible through the transparent covering whenever the front wall 24 of the cover 20 is positioned over the compartment 12 in juxtaposition with the lid 18.

While no particular application has been mentioned for the package 10, a wide variety of applications will be apparent. The package 10 is well suited for virtually any kit such as those for arts or crafts where materials of various types, such as paints, pencils, knives, markers, and raw arts and crafts materials are provided. Still additionally, the package 10 is especially well suited for any of various applications that will include or require an activity book or the like.

While in the foregoing specification a detailed description of the preferred embodiment of the invention has been given, it will be appreciated that the details herein given may be varied by those skilled in the art without departing from the true spirit and scope of the appended claims.

What is claimed is:

1. A package for a kit, comprising:

a compartment for storing materials defined by a side wall and a bottom wall, and a lid for overlying said compartment to selectively close and open said compartment; and a cover for said materials storing compartment defined by a side wall and a front wall;

said cover being removably positionable over said compartment in box-like fashion with said front wall of said cover in juxtaposition with said lid of said compartment;

said bottom wall defining said materials storing compartment extending beyond at least part of said side wall to form a flap;

at least one of said lid and said cover being hinged to said flap formed by the portion of said bottom wall which extends beyond said side wall.

2. The kit package of claim 1 wherein said materials storing compartment is generally rectangular in shape and has an open top, and said side wall defining said materials storing compartment includes four side wall portions integral with said bottom wall thereof.

3. The kit package of claim I wherein said lid is hinged to said flap for pivoting said lid from said position overlying said compartment to thereby open said compartment.

4. The kit package of claim 1 wherein said materials storing component cover is generally rectangular in shape and has an open bottom opposite said front wall, and said side wall defining said compartment cover includes four side wall portions integral with said front wall thereof.

5. The kit package of claim 1 wherein said cover is hinged to one of said side wall and said bottom wall defining said materials storing compartment for pivoting said cover from juxtaposition with said lid to expose said lid for opening said compartment.

6. The kit package of claim 1 wherein said materials storing compartment cover includes a window in said front wall of said cover for viewing an image on or between said lid and said front wall whenever said front wall is in juxtaposition with said lid.

7. A package for a kit, comprising:

a compartment for storing materials defined by a side wall and a bottom wall and a lid for overlying said compartment to selectively close and open said compartment, said materials storing compartment being generally rectangular with an open top opposite said bottom wall, and said side wall defining said materials storing compartment including four integral side wall portions integrally associated with said bottom wall thereof; and a cover for said materials storing compartment defined by a side wall and a front wall and including a window in said front wall for viewing an image therethrough, said materials storing component cover being generally rectangular with an open bottom opposite said front wall, and said side wall defining said materials storing compartment cover including integral side wall portions integrally associated with said front wall thereof;

said bottom wall defining said materials storing compartment extending beyond at least one of said side wall portions of said materials storing compartment to form at least one flap;

at least one of said lid and said cover being hinged to one of said flaps formed by the portion of said bottom wall which extends beyond said side wall portions of said materials storing compartment;

said cover being removably positionable over said compartment in box-like fashion with said front wall of said cover in juxtaposition with said lid of said compartment.

8. The kit package of claim 7 wherein said lid is hinged to one of said flaps for pivoting said lid from a first position overlying said compartment wherein said compartment is closed to a second position generally adjacent said compartment wherein said compartment is open.

9. The kit package of claim 7 wherein said cover is hinged to one of said flaps for pivoting said cover from a first position over said compartment with said front wall and said lid juxtaposed to a second position generally adjacent said compartment to expose said lid for opening said compartment.

10. The kit package of claim 7 wherein said window in said front wall of said materials storing compartment cover is defined by an opening through said front wall having a transparent covering for viewing an image positioned on said lid or an article between said lid and said front wall whenever said front wall is positioned over said component in juxtaposition with said lid.

11. The kit package of claim 7 wherein said bottom wall and side wall portions defining said materials storing compartment form a rectangular box having a top, a bottom, and a pair of sides, one of said flaps being associated with one of said top and bottom of said rectangular box, said materials storing compartment cover being hinged to said flap associated with one of said top and bottom of said rectangular box and said lid being hinged to one of said sides of said rectangular box.

12. The kit package of claim 11 wherein said bottom wall defining said materials storing compartment extends beyond said side wall portions along said sides of said rectangular box to form flaps to be folded against the corresponding ones of said side wall portions before said cover is removably positioned over said rectangular box in box-like fashion.

13. The kit package of claim 12 wherein said lid is hinged to one of said flaps formed by the portion of said bottom wall which extends beyond said side wall portions to be pivoted to a first position overlying said compartment for closing said compartment when said one of said flaps is folded against the corresponding one of said side wall portions.

14. A package for a kit, comprising:

a compartment for storing materials defined by a side wall and a bottom wall and a lid for overlying said compartment to selectively close and open said compartment, said materials storing compartment being generally rectangular with an open top opposite said bottom wall, and said side wall defining said materials storing compartment including four integral side wall portions integrally associated with said bottom wall thereof;

said bottom wall defining said materials storing compartment extending beyond at least one of said side wall portions of said materials storing compartment to form at least one flap to be folded;

said lid being hinged to one of said flaps formed by the portion of said bottom wall which extends beyond said side wall portions of said materials storing compartment for pivoting said lid from a first position overlying said compartment wherein said compartment is closed to a second position generally adjacent said compartment wherein said compartment is open; and a cover for said materials storing compartment defined by a side wall and a front wall and including a window in said front wall for viewing an image therethrough, said materials storing compartment cover being generally rectangular with an open bottom opposite said front wall, and said side wall defining said materials storing compartment cover including integral side wall portions integrally associated with said front wall thereof;

said cover being removably positionable over said compartment in box-like fashion with said front wall of said cover in juxtaposition with said lid of said compartment;

said cover being hinged to another of said flaps formed by the portion of said bottom wall which extends beyond said side wall portions of said materials storing compartment for pivoting said cover from a first position over said compartment with said front wall and said lid juxtaposed to a second position generally adjacent said compartment to expose said lid for opening said compartment;

said bottom wall and side wall portions defining said materials storing compartment forming a rectangular box having a top, a bottom, and a pair of sides, and said materials storing compartment cover being hinged to said top of said rectangular box and said lid being hinged to one of said sides thereof.

15. The kit package of claim 14 wherein said window in said front wall of materials storing compartment cover is defined by an opening through said front wall having a transparent covering for viewing an image positioned on said lid or an article between said lid and said front wall whenever said front wall is positioned over said compartment in juxtaposition with said lid.

16. The kit package of claim 14 wherein said bottom wall defining said materials storing compartment extends beyond said side wall portions along said sides of said rectangular box to form flaps to be folded against the corresponding ones of said side wall portions before said cover is removably positioned over said rectangular box in box-like fashion.

17. The kit package of claim 16 wherein said bottom wall defining said materials storing compartment extends beyond said side wall portions at least along said top of said rectangular box to form a hinge line spaced therefrom and said cover is hinged to said extended bottom wall at said hinge line to be removably positioned over said compartment in box-like fashion.

18. The kit package of claim 17 wherein said bottom wall also extends beyond said side wall portions along said bottom of said rectangular box and includes a tuck flap defined by a hinge line spaced from said bottom of said rectangular box having a pair of opposed flap extensions to be inserted into flap extension-receiving openings in said cover.

19. The kit package of claim 17 wherein said bottom wall extends beyond said top of said rectangular box by a distance greater than the height of said side wall portions of said cover to accommodate placement and support of a book between said side wall portions of said cover and said top of said rectangular box when said cover has been pivoted to be perpendicular to said box.

20. The kit package of claim 18 including an oblong finger-receiving flap formed in the portion of said bottom wall between said bottom of said rectangular box and said hinge line, said oblong finger-receiving flap being generally parallel to said side wall portion along said bottom of said rectangular box and generally parallel to said tuck flap.

21. The kit package of claim 14 wherein said lid has a cutting board integral with the surface facing said rectangular box when said lid is in said first position overlying said compartment, said rectangular box having a divider for forming at least two supply-receiving compartment portions and an activity book to be positioned between said lid and said front wall of said cover.

22. The kit package of claim 14 wherein said lid has a tuck flap to be inserted into said rectangular box when said lid is in said first position overlying said compartment to thereby close said compartment.

23. The kit package of claim 15 wherein said article comprises an activity book having an image to be viewed through said transparent covering on said opening through said front wall.

24. The kit package of claim 1 wherein said materials storing compartment cover is generally rectangular in shape and has an open bottom opposite said front wall, and said side wall defining said compartment cover includes three side wall portions integral with said front wall thereof and a side lacking a side wall, and said compartment cover is hinged at said side lacking a side wall to one of said flaps.

25. The kit package of claim 7 wherein said bottom wall and side wall portions defining said materials storing compartment form a rectangular box having a top, a bottom, and a pair of sides, at least one of said flaps being associated with one of said sides, said materials storing compartment cover being hinged to one of said top and bottom of said rectangular box and said lid being hinged to one of said flaps associated with one of said sides of said rectangular box.

* * * * *